United States Patent [19]

Willis

[11] 3,987,643

[45] Oct. 26, 1976

[54] THERMODYNAMIC BEVERAGE COOLING UNIT

[76] Inventor: Samuel C. Willis, 5419 Hickory Hill Road, Louisville, Ky. 40214

[22] Filed: Jan. 22, 1975

[21] Appl. No.: 542,928

Related U.S. Application Data

[63] Continuation of Ser. No. 435,305, Jan. 21, 1974, abandoned.

[52] U.S. Cl. ..... 62/371; 62/294

[51] Int. Cl.[2] ..... F25D 3/10

[58] Field of Search ..... 62/294, 371

[56] References Cited

UNITED STATES PATENTS

| | | | |
|---|---|---|---|
| 2,805,556 | 9/1957 | Wang | 62/294 |
| 3,269,141 | 8/1966 | Weiss | 62/294 |
| 3,309,890 | 3/1967 | Barnett | 62/294 |
| 3,597,937 | 8/1971 | Parks | 62/294 |
| 3,636,726 | 1/1972 | Rosenfeld | 62/294 |

*Primary Examiner*—William E. Wayner
*Attorney, Agent, or Firm*—John G. Schenk

[57] ABSTRACT

Beverage cooling apparatus utilizing such gaseous coolants as carbon dioxide and chlorofluorohydrocarbon refrigerants are the subject of several patents. These cooling units entail a cooling coil adapted to be positioned within the beverage in combination with a reservoir from which gas passes through the cooling coil surrounded by the liquid beverage. The cooling apparatus herein is of the type including a reservoir and a cooling unit, but it is improved to make greater use of the latent heat of vaporization.

5 Claims, 7 Drawing Figures

THERMODYNAMIC BEVERAGE COOLING UNIT

This is a continuation of application Ser. No. 435,305, filed Jan. 21, 1974, now abandoned.

This invention pertains to the cooling of beverages, juices, milk shakes, and other edible liquids which are shipped, stored, and consumed from cooled cans.

BACKGROUND OF THE INVENTION

U.S. Pat. Nos. 3,269,141 and 3,520,148 describe unitary self-cooling containers for potable materials which operate with carbon dioxide cartridges in conjunction with heat exchange means such as a coil or a jacket into which the refrigerant gas flows.

In U.S. Pat. No. 3,269,141 a compressed gas is released to flow without restriction through a coil immersed in the beverage, utilizing the cooling which occurs due to gas expansion. In U.S. Pat. No. 3,520,148 a cartridge of compressed gas is released in such a manner that the released gas is directed over the outside of the can by a cardboard shield, cooling being achieved as the gas expands and flows around the container.

U.S. Pat. No. 3,636,726 describes a cooling means for beverages which utilizes chlorofluorohydrocarbon refrigerants. This self-cooling container, while reducing the temperature of the beverage to about 40° F., is not entirely satisfactory. In the cooling apparatus of U.S. Pat. No. 3,636,726 gas escapes from a reservoir, passes through a throttle, and flows through a cooling coil. The beverage is cooled by this flow of expanding gas through the coil and by contact with the top surface of the reservoir, which is made of a metal of high thermal conductivity. However only one of the surfaces of the auxiliary reservoir, less than half of its total surface, is in contact with the beverage. As a consequence this beverage cooling apparatus is not sufficiently efficient for some uses. It is an object of this invention to provide an edible liquid cooling apparatus which more readily lends itself to its end uses.

SUMMARY OF THE INVENTION

The invention herein maximizes the cooling efficiency achievable by apparatus of the type described in U.S. Pat. No. 3,636,726 by greater use of the latent heat vaporization of the refrigerant employed. A liquid instead of a gaseous refrigerant flows into the coil. The cooling apparatus thus is the type including a cooling element adapted to be positioned within an edible liquid. The cooling coil is provided with an outlet terminating in a vent above the edible liquid level and an inlet integral with and opening into a refrigerant container whereby refrigerant material flows from the container through said coil and out said vent. According to the practice of this invention liquid cooling can be obtained with less refrigerant. The invention herein contemplates a refrigerant container adapted to hold refrigerant in its liquid form. Release valve means confines the liquid refrigerant in said container when said valve means is in its closed position. Flow means permits said refrigerant to flow to said coil in liquid form when said release valve means is open so that vaporization takes place in the cooling coil rather than in the refrigerant container. Flow control means are employed to regulate liquid flow through the coil.

DETAILED DESCRIPTION OF THE INVENTION

This invention is based upon the use of an expansion valve whose cross-sectional area is correlated with the cross section of the cooling coil so as to permit maximum use of the refrigerant. The refrigerant container or reservoir provided herein is adapted so that the refrigerant in liquid form passes through the expansion valve into the cooling coil where it rapidly changes from the liquid to the gaseous state absorbing from the beverage its heat of vaporization, further expansion of the gas as it flows through the coil thereby providing further cooling of the system.

This invention will be better understood by reference to the accompanying drawings, which are, of course, for the purpose of exemplification only in view of variations which are possible.

Figure 1:
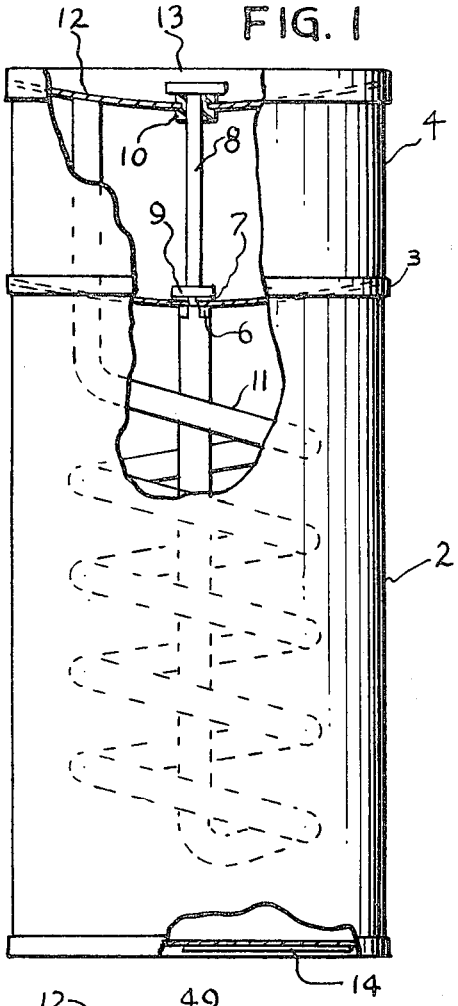
FIG. 1 is an elevational view, partially broken away of one form of the cooling apparatus of the invention.

Referring now to FIG. 1, the container 2 is any standard beverage can, not to be considered a part of the invention. In the cooling attachment, refrigerant reservoir 4 is a unit large enough to hold sufficient refrigerant in the liquid state and hence under pressure. In other words the refrigerant is held in the liquid state due to its own vapor pressure.

Reservoir 4, attached to the can by weld or other seam 3, is designed with concave and convex upper and lower surfaces to provide adequate strength to withstand refrigerant pressure. The bottom of the reservoir slopes downwardly within to assure flow of the refrigerant through the expansion valve 6 in the liquid state and not as a gas. The expansion valve in this embodiment is in the form of a disc valve. On the face of the disc is an adhesive coating 7, the valve being normally closed by disc 9 by the pressure of the refrigerant liquid aided by the adhesive. Knob 13 of stem 8 is pulled to open a liquid passage to the expansion valve. Valve stem 8 passes through seal 10 in the top of the liquid refrigerant container. When the valve is opened, the liquid flashes or rapidly vaporizes to a gas as it enters the cooling coil 11. In the coil, therefore, due to the heat of vaporization of the liquid, heat energy is withdrawn from beverage surrounding the coil. Cooling element 11 is a coiled section of thin-walled metal of high thermal conductivity such as aluminum tubing. An exhaust port 12 allows the expanded vented gas to escape into the air. A can opening tab 14 is fabricated on the bottom of the can.

Figure 2:
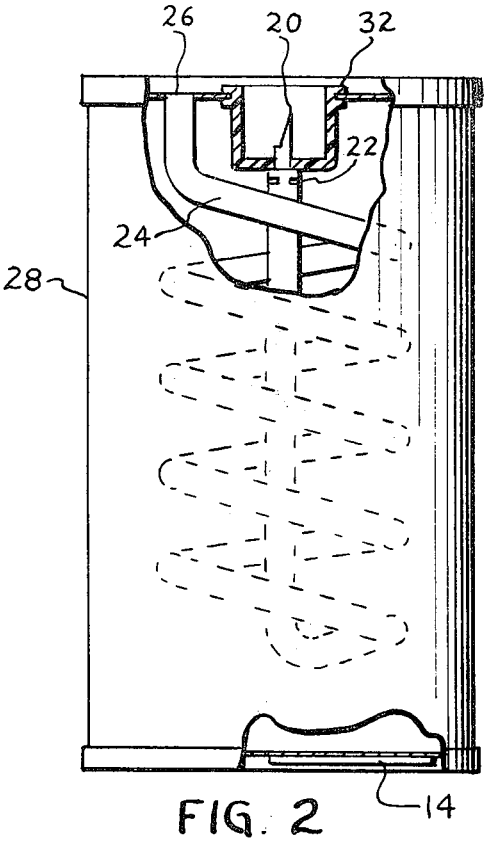
FIG. 2 is a similar view of a cartridge type cooling apparatus, without the refrigerant cartridge.
Figure 3:
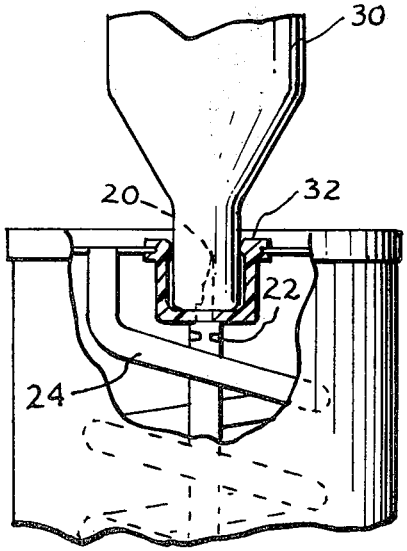
FIG. 3 is a view showing how the cartridge fits on the device of FIG. 2.

Referring now to FIG. 2, a cooling unit is illustrated which is adapted to receive a cartridge. The cooling unit includes a perforator 20, expansion valve 22, coiled cooling tube 24, and vent opening 26. This unit is also shown to be integral with a standard size beverage can 28 as will be the case with carbonated beverages which must remain sealed during cooling. Activation of the apparatus of FIG. 2 occurs when the neck of cartridge 30, containing the refrigerant in liquid state, is forced into the resilient collar or flexible seat 32 as shown in FIG. 3. In this embodiment of the invention accidental delivery of the refrigerant to heat exchanger 24 is prevented. Perforator 20 punctures the cartridge, allowing the liquid refrigerant to flow through the expansion valve 22 into cooling coil 24 where it undergoes vaporization, thererby absorbing from the beverage its heat of vaporization. The gas then further expands as it passes through the cooling coil, cooling the beverage during this travel.

In use, the beverage can with the attached cooling unit of this invention is placed in a vertical position with the refrigerant reservoir on top. In the embodiment illustrated in FIG. 1, the can is grasped with one hand and the release valve handle 13 is pulled with the other hand, initiating the flow of liquid refrigerant through the expansion valve into the cooling coil. When the sound of escaping gas ceases, the beverage can is inverted and gently agitated for a few seconds. The opening tab can then be pulled since the beverage is ready for consumption. In the embodiment shown in FIG. 2 the cooling unit again is placed in a vertical position with the perforator on top. A cartridge containing a liquid refrigerant is thrust downwardly onto the perforator in the position described in conjunction with FIG. 3. The liquid in the container will then be cooled as has been described.

From the foregoing description it can be seen that this invention involves a unique design which utilizes both the cooling which occurs as a liquid refrigerant passes through a miniature expansion valve absorbing its heat of vaporization in the cooling coil plus the added cooling which occurs as the gaseous phase continues to expand in the cooling coil on its way to the exhaust port. The invention thus provides a highly efficient means for cooling beverage or liquid foods in cans. Apparatus heretofor has not utilized means such that the refrigerant must pass into the cooling element in the liquid phase.

It will be understood that since the refrigerant is permitted to flow into the cooling element in its liquid state when the release valve is opened flow control means must be provided. Otherwise liquid-vapor refrigerant would either flow through the cooling element without accomplishing maximum cooling of the contents of the can, or if the contents were cooled an inordinate quantity of refrigerant would be required. The refrigerant flow rate is, of course, related to the length of the flow passage through the cooling element and particularly to the size of the expansion valve. Accordingly it is impossible to assign specific flow rates to the apparatus of the invention. Thus the shorter the flow path, the slower must be the flow rate. The flow rate can be controlled by any of the known liquid valves, but it is convenient to employ a sized orifice type expansion valve. As a specific example, to cool a 10-ounce can containing a soft drink so as to lower the temperature 40° F., an aluminum cooling coil, i.d. 0.18 inches, 28 to 32 inches in length, is used in the apparatus shown in FIG. 1. If the expansion valve opening is larger than 0.014 cooling efficiency, and hence the amount of refrigerant, is sacrificed. In addition if the orifice is too small insufficient refrigerant flows through the cooling coil to effectively lower the temperature. Thus if the orifice is smaller than 0.009 refrigerant flow is so slow that effective cooling is not achieved in a reasonable time. With the expansion valve size of 0.0115, 5.95 ounces of $CCl_2F_2$ will cool a 10-ounce soft drink 40° (F.) in 2 minutes. The size of the expansion valve and its relationship to the cooling element thus depend on such factors as the heat of vaporization of the refrigerant, its viscosity, the flow characteristics of the cooling element, the quantity of material being cooled, and its characteristics. Obviously, therefore, the relationships cannot be set down with precision for all applications. However, the size of the expansion valve, the refrigerant and the cooling coil length should be such that the temperature differential between the temperature of the beverage and the vent outlet temperature is minimal throughout the cooling cycle. They should be within 15° F., preferably 8° F., of each other during the cooling cycle. As a guide this condition obtains if the coil length, release valve and refrigerant are so correlated that the cooling period is less than 2 and one-half minutes in length, generally in less than 2 minutes.

It has been pointed out that less refrigerant can be used by the practice of this invention. Thermodynamic calculations using the following equation involving the mass of the refrigerant, the mass of the beverage (both in pounds) and the desired temperature drop ($\Delta T$ in btu's) $M_r = M_b \Delta T / H_{lat}$ show that the theoretical quantity of $CCl_2F_2$ necessary to cool 12 ounces of a cola beverage a 40° F. drop is 0.42 pound. By the practice of this invention a 12-ounce can of a cola beverage can be cooled 40° (F.) with 0.44 pound of $CCl_2F_2$. Because of this close approach to the theoretical quantity the unit is called a thermodynamic cooling unit.

In accordance with this invention it has been found that cooling begins within the cooling tube at the outlet of the expansion valve. Since in this cooled section of the tube vaporization of the liquid refrigerant is inhibited, the point of vaporization moves progressively along the cooling coil toward the vent. The point of evaporation thus moves progressively and uniformly along substantially the entire length of the cooling coil. This is evident from the progressive formation of ice along the outside of the coil. As a result of this cooling process, the length of the cooling tube varies directly as to the time of the cooling cycle, i.e. the time it takes for this progressive vaporization along the coil. This becomes a factor to be considered when the invention is to be used in containers of different capacities.

Referring now to the refrigerant, a high latent heat of vaporization is clearly desirable, along with a safe pressure should the beverage prior to use be exposed to high temperatures, say up to 130° F., as are possible in normal transport of the unit. Desirable refrigerants are the "Freons", for instance $CCl_2F_2$, $CHCl_2F$ and CCL 3F, although the other non-toxic refrigerants having desirable vapor pressures and high heats of vaporization can be employed, the refrigerant being one capable of existing in liquid form in the reservoir or cartridge.

Figure 4:
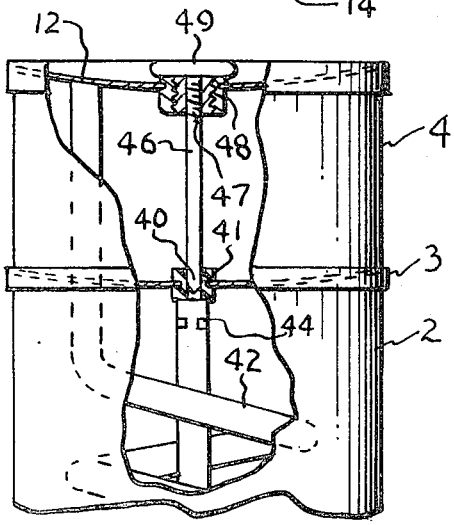
FIG. 4 is a partial view of an apparatus similar to that of FIG. 1 but with a different reservoir valve arrangement.
Figure 7:
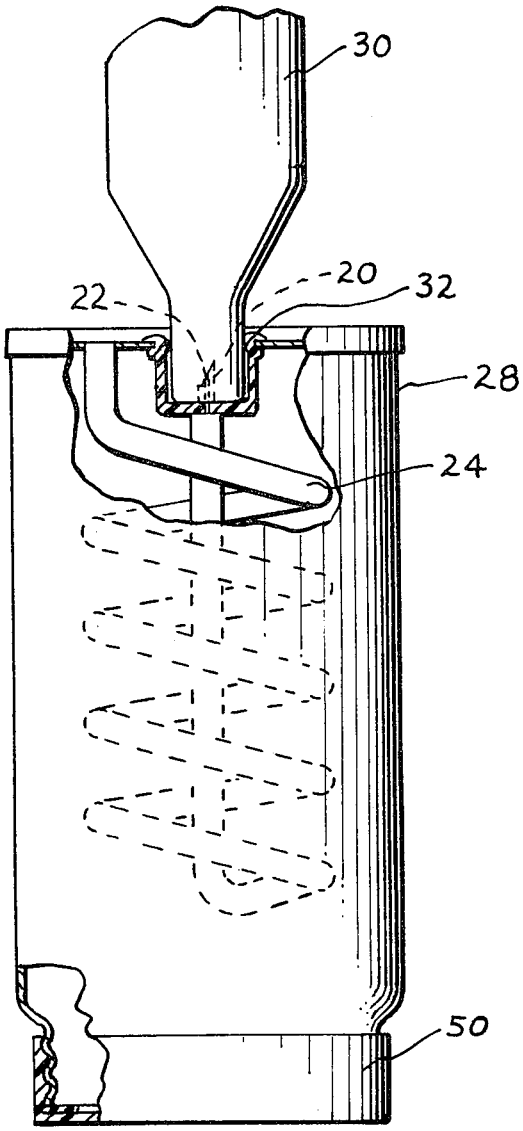
FIGS. 5, 6 and 7 show three forms of the invention for use with edible liquids other than carbonated beverages.
Figure 5:
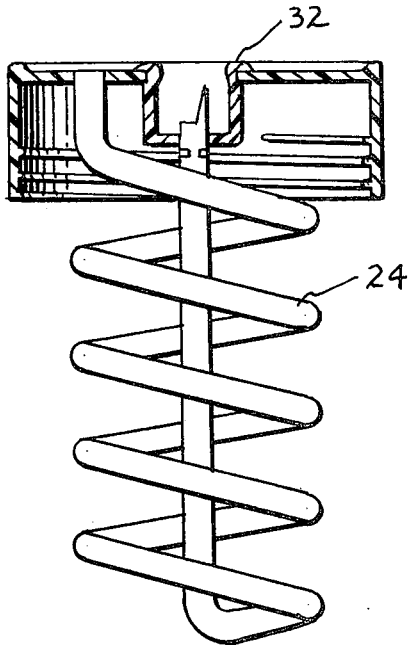
Figure 6:
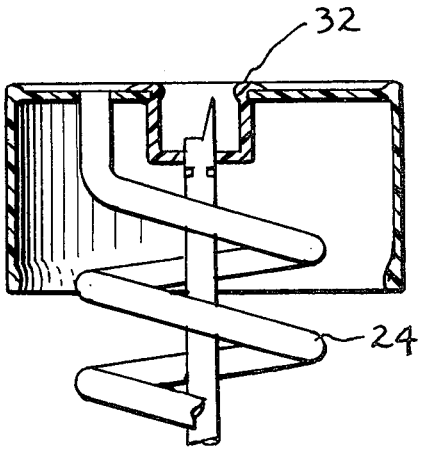

Having been given the teachings of this invention modifications and variations will, of course, occur to those skilled in the art. Thus instead of the disc valve shown in FIG. 1, which functions both as a release valve and as an expansion valve, separate valves can be employed as shown in FIG. 4. The refrigerant is held in container 4 by needle valve 40 which seats in plastic seal 41 to close the opening to cooling coil 42. Beneath release valve 40 is expansion valve 44 properly sized in relation to the cooling coil and having a smaller opening than that in the release valve which will be sufficiently large, say over 0.1 inch so that there will be liquid flow to the expansion valve. Needle valve stem 46 is threaded at 47 as is seal 48. The valve is then opened by turning knob 49. In other embodiments of the invention a cooling unit is made for attachment or insertion in the container to be cooled. As illustrated in FIG. 5 the cooling unit can be in the form of a threaded lid to be screwed on a can or jar. A snap on unit shown in FIG. 6 can also be made. In FIG. 7 a jar-type cooling unit with threaded cap 50 is shown. In another variation further cooling can be achieved by merely increasing the quantity of refrigerant. It will be understood also that this invention is applicable to a variety of edible liquids in addition to beverages, such as ice cream, frosted confections, other frozen dairy products and the like. The units of FIGS. 5, 6 and 7 are particularly suited to such use. These and other ramifications are, therefore, deemed to be within the scope of this invention.

What is claimed is:

1. In a cooling apparatus for edible liquids, which is of the type including a cooling element adapted to be positioned within the edible liquid, said cooling element having an outlet terminating in a vent above the edible liquid level, and an inlet integral with and opening into a refrigerant container whereby refrigerant is conveyed from the container to the cooling element, flowing through the cooling element and out said vent, the improvement whereby colder liquid temperatures are obtained with less required refrigerant, comprising a refrigerant container adapted to hold refrigerant in its liquid form, release valve means confining the liquid refrigerant in said container when said valve means is in its closed position, flow means admitting said refrigerant to the cooling element in liquid form when said release valve means is open so that vaporization takes place in the cooling element rather than in the refrigerant container, flow control means regulating liquid flow into said cooling element at a rate such that vaporization takes place progressively along the cooling element to maintain a minimum temperature differential between the edible liquid temperature and the vent temperature throughout the cooling cycle as determined by a cooling period of less than 2 and one-half minutes wherein said release valve means is a normally closed needle valve capable of being opened from outside the container.

2. In a cooling apparatus for edible liquids, which is of the type including a cooling element adapted to be positioned within the edible liquid, said cooling element having an outlet terminating in a vent above the edible liquid level, and an inlet integral with and opening into a refrigerant container whereby refrigerant is conveyed from the container to the cooling element, flowing through the cooling element and out said vent, the improvement whereby colder liquid temperatures are obtained with less required refrigerant, comprising a refrigerant container adapted to hold refrigerant in its liquid form, release valve means confining the liquid refrigerant in said container when said valve means is in its closed position, flow means admitting said refrigerant to the cooling element in liquid form when said release valve means is open so that vaporization takes place in the cooling element rather than in the refrigerant container, flow control means regulating liquid flow into said cooling element at a rate such that vaporization takes place progressively along the cooling element to maintain a minimum temperature differential between the edible liquid temperature and the vent temperature throughout the cooling cycle as determined by a cooling period of less than 2 and one-half minutes wherein said cooling apparatus is integral with the beverage container and is mounted on the top thereof.

3. In a cooling apparatus for edible liquids, which is of the type including a cooling element adapted to be positioned within the edible liquid, said cooling element having an outlet terminating in a vent above the edible liquid level, and an inlet integral with and opening into a refrigerant container whereby refrigerant is conveyed from the container to the cooling element, flowing through the cooling element and out said vent, the improvement whereby colder liquid temperatures are obtained with less required refrigerant, comprising a refrigerant container adapted to hold refrigerant in its liquid form, release valve means confining the liquid refrigerant in said container when said valve means is in its closed position, flow means admitting said refrigerant to the cooling element in liquid form when said release valve means is open so that vaporization takes place in the cooling element rather than in the refrigerant container, flow control means regulating liquid flow into said cooling element at a rate such that vaporization takes place progressively along the cooling element to maintain a minimum temperature differential between the edible liquid temperature and the vent temperature throughout the cooling cycle as determined by a cooling period of less than 2 and one-half minutes wherein said apparatus is insertable in the top of a beverage container and is adapted for attachment thereto.

4. The cooling apparatus of claim 3 wherein the refrigerant container is a separate cartridge and wherein the cooling apparatus is adapted to receive said cartridge.

5. In a cooling apparatus for edible liquids, which is of the type including a cooling element adapted to be positioned within the edible liquid, said cooling element having an outlet terminating in a vent above the edible liquid level, and an inlet integral with and opening into a refrigerant container whereby refrigerant is conveyed from the container to the cooling element, flowing through the cooling element and out said vent, the improvement whereby colder liquid temperatures are obtained with less required refrigerant, comprising a refrigerant container adapted to hold refrigerant in its liquid form, release valve means confining the liquid refrigerant in said container when said valve means is in its closed position, flow means admitting said refrigerant to the cooling element in liquid form when said release valve means is open so that vaporization takes place in the cooling element rather than in the refrigerant container, flow control means regulating liquid flow into said cooling element at a rate such that vaporization takes place progressively along the cooling element to maintain a minimum temperature differential between the edible liquid temperature and the vent temperature throughout the cooling cycle as determined by a cooling period of less than 2 and one-half minutes wherein said cooling element is a cooling coil, wherein the flow means include a refrigerant outlet tube in the bottom of the refrigerant container, wherein the release valve means closes said tube opening, and wherein the flow control means is an exapansion valve in said tube.

* * * * *